US006353164B1

(12) United States Patent
Corsi

(10) Patent No.: US 6,353,164 B1
(45) Date of Patent: Mar. 5, 2002

(54) STRINGED INSTRUMENT WITH FOLDING NECK

(76) Inventor: Stephen David Corsi, 1250A Westerly Terr., L.A., CA (US) 90027

( * ) Notice: Subject to any disclaimer, the term of this patent is extended or adjusted under 35 U.S.C. 154(b) by 0 days.

(21) Appl. No.: 09/612,189

(22) Filed: Jul. 7, 2000

(51) Int. Cl.[7] ..... G10D 3/00
(52) U.S. Cl. ..... 84/293; 84/290; 84/292
(58) Field of Search ..... 84/718, 743, 290, 84/291, 292, 293

(56) References Cited

U.S. PATENT DOCUMENTS 4,073,211 A * 2/1978 Jorgensen ..... 84/293
4,191,085 A * 3/1980 Litwin ..... 84/293
5,390,578 A * 2/1995 Raymer ..... 84/291
5,886,270 A * 3/1999 Wynn ..... 84/313
5,949,005 A * 9/1999 Peterson ..... 84/291

* cited by examiner

*Primary Examiner*—Robert E. Nappi
*Assistant Examiner*—Kim Lockett
(74) *Attorney, Agent, or Firm*—Patent Pro

(57) ABSTRACT

A stringed instrument has an instrument body, a neck pivotally attached to the body so as to allow rotation of neck from an operative position to a folded position and a string mount rotatably secured to the instrument body. At least one string has a first and a second end, the first end is attached to neck portion and the second end is attached to the string mount. A drive mechanism is also included for rotating the string mount in direct response to pivotal movement of the neck towards said body so as to wind the at least one string onto the string mount when the neck is pivotally moved between the operative position to the folded position. In a preferred embodiment rotation of the string mount preserves tension in the at least one string when the neck is pivotally moved from the operative to the folded position. When the neck is in the folded position the at least one string is stowed substantially wound on the string mount.

23 Claims, 9 Drawing Sheets

STRINGED INSTRUMENT WITH FOLDING NECK

BACKGROUND OF THE INVENTION

This invention relates generally to musical instruments, and more particularly to stringed instruments designed to collapse for travel.

String musicians, especially guitarists, have long desired for convenient access to an instrument during their travels, so that wherever they may be, they may reach for their instrument and play it. However, due to the size and delicacy of string instruments like the guitar, it has never been fully practical to carry such an instrument with one's hand luggage for impromptu use.

The usual attempt to provide a travel stringed instrument typically involves scaling down the dimensions of a standard instrument. However, when in use, the musician is required to compensate for the difference in size and accept the consequent adverse effect on his playing. Additionally, none of the scaled down instruments are compact enough not to be bothersome during one's non-playing activities. Thus it may be concluded that the travel stringed instrument desired by musicians must be a full-scale instrument collapsible in some fashion. A search of prior art has revealed the following representative patents for collapsible stringed instruments cited below.

U.S. Pat. No. 4,073,211 to Jorgensen discloses a guitar with a neck pivotally attached to its body so that it may swing downwards and be stored in a recess in the back of the body. To account for increased string travel around the body, the Jorgensen instrument requires the operator to manually move the string mount from a first position to a second position toward the neck, and manually place the strings into grooves defined in the instrument body. This procedure is disadvantageous because it requires excessive time and patience from the operator each time the instrument is transformed. In addition, the instrument needs to be re-tuned when the neck is returned to its operative position. Furthermore, due to the direction of pivotal neck motion, the Jorgensen instrument has too small a surface area to produce rigid contact between neck and body when the neck is in its operative position, thus adversely effecting the instrument's tonal characteristics.

Like the Jorgensen instrument, U.S. Pat. No. 4,111,093 to Field and Steger also features a neck that is pivotally attached to the instrument body so that it may swing downward and be stored in the back of the body. In order to account for the increased string travel around the back of the instrument, Field and Steger teach a moveable string mount in communication with the pivotal attachment of neck to body by gears and gear rods; a return roller with grooves connected to the pivot supports the strings as they pass around the back of the instrument. In practice however, this instrument would necessitate the return roller to protrude above the body to properly support the instrument's strings when the instrument is transformed thus greatly diminishing the available upper surface area which would compromise the playing of the operator. If the return roller lies below the body, the strings will be subject to sharp contact with the neck and body when the neck is folded.

As with the Jorgensen instrument, the Field Steger design also suffers from a lack of rigid contact between neck and body due to its neck motion with the likely result of poor tonal quality. Additionally, the presence, complexity and necessary arrangement of the gears, rods and return roller in the neck, is likely to further degrade tonal quality and disadvantageously increase the size of the instrument.

U.S. Pat. No 4,191,085 to Litwin and U.S. Pat. No. 4,638,708 to Kamal are prior art examples of collapsible stringed instruments that burden the user with complete detachment of the neck every time the instrument is transformed. This procedure requires excessive time and patience and also makes present the danger that the instrument's strings be subject to sharp bending and buckling which would make a pure tuning of the instrument impossible when reassembled. U.S. Pat. No. 5,383,385 to Gilbert discloses a guitar with a neck that folds up on top of the body by way of two parallel swingable links. However, this arrangement takes no account of the strings leaving them free to fall tangled and prey to bending and buckling, this makes a pure tuning of the instrument unlikely when the neck is returned to its operative position. In addition, in order to overcome string tension, the operator may be subject to over exertion by being required to forcibly lever the neck when returning it to its operative position.

U.S. Pat. No. 5,390,578 to Raymer teaches a guitar with a neck rotatably attached to a body to allow rotation of the neck on a parallel plane in relation to the main surfaces of the body from an open position to a stowed position within a body recess at an angle juxtaposed from the longitudinal axis defined by the neck in its open position. This arrangement would necessitate an undesirable width for a travel instrument body. As with the Gilbert design, no provision is made to ensure that the guitar strings are free from bending and buckling making a quick and pure tuning of the instrument improbable when returned to playable form. In addition, due to string tension, the user is burdened by being subject to possible over exertion by being required to lever the neck to its open position.

It can be concluded from the above analysis, that prior art has thus far failed to provide a design for a collapsible stringed instrument that stows its strings in an optimum manner in order to avoid damage to them, folds into a compact space for travel, transforms quickly from travel form to operative form and when in operative form, retains the neck body rigidity of a high quality instrument. Furthermore, because these designs must be dismantled for travel or leave delicate parts exposed when traveling, the use of a bulky case is a strict necessity for carrying them to avoid damage. This requirement is a further disadvantage for a travel instrument.

SUMMARY OF THE INVENTION

It is an object of the present invention to provide an instrument that may be collapsed without disassembly or further adjustment to string tension and that when collapsed, stows all strings in an optimum manner in order to avoid damage to them.

It is another object of the invention to provide a stringed instrument that may be frequently transformed between a playing form and a travel form whilst retaining string tension and string tuning.

Another object is to provide a collapsible stringed instrument with improved portability and space saving benefits yet when in an operative form becomes a full-scale length instrument playable as customary instruments.

A further object is to provide an instrument that protects its critical parts when in its travel form thus negating the strict need to transport the instrument in case.

In accordance with a preferred embodiment of the present invention, a stringed instrument with folding neck comprises an instrument body; a neck pivotally attached to body so as to allow rotation of neck from an operative position to a folded position; a string mount rotatably secured to said instrument body; at least one string having a first and a second end said first end attached to the neck, the second end attached to the string mount; and drive means for rotating the string mount in direct response to pivotal movement of said neck towards said body so as to wind said at least one string onto the string mount when said neck is pivotally moved between said operative position to said folded position.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
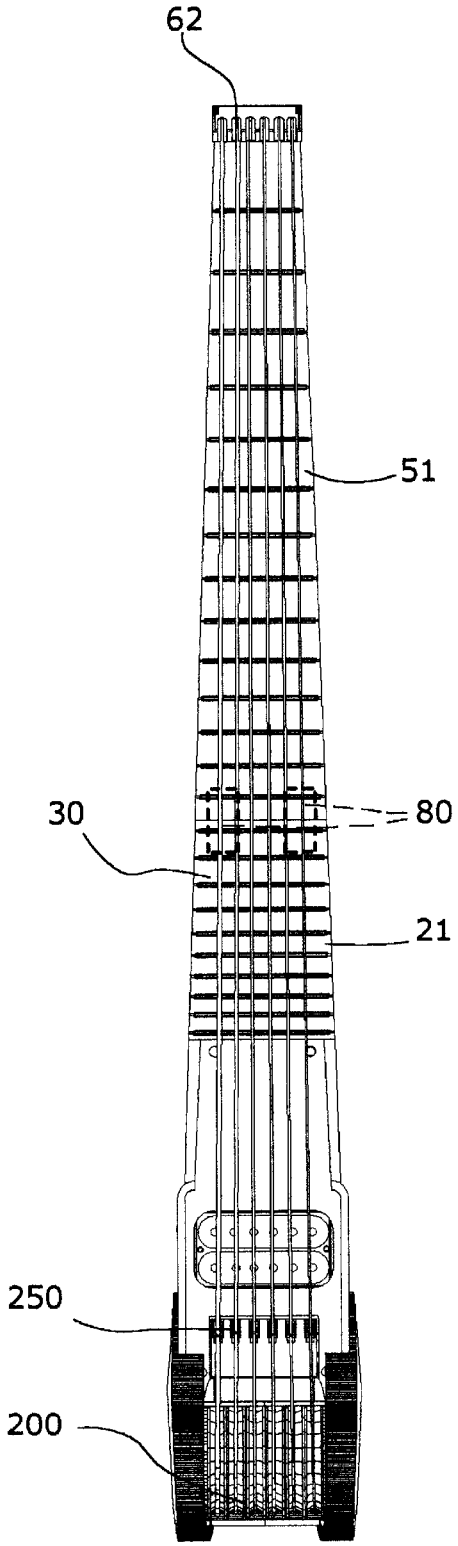
FIG. 1 is a top plan view of a preferred embodiment of the invention with the neck in its operative position.
Figure 2:
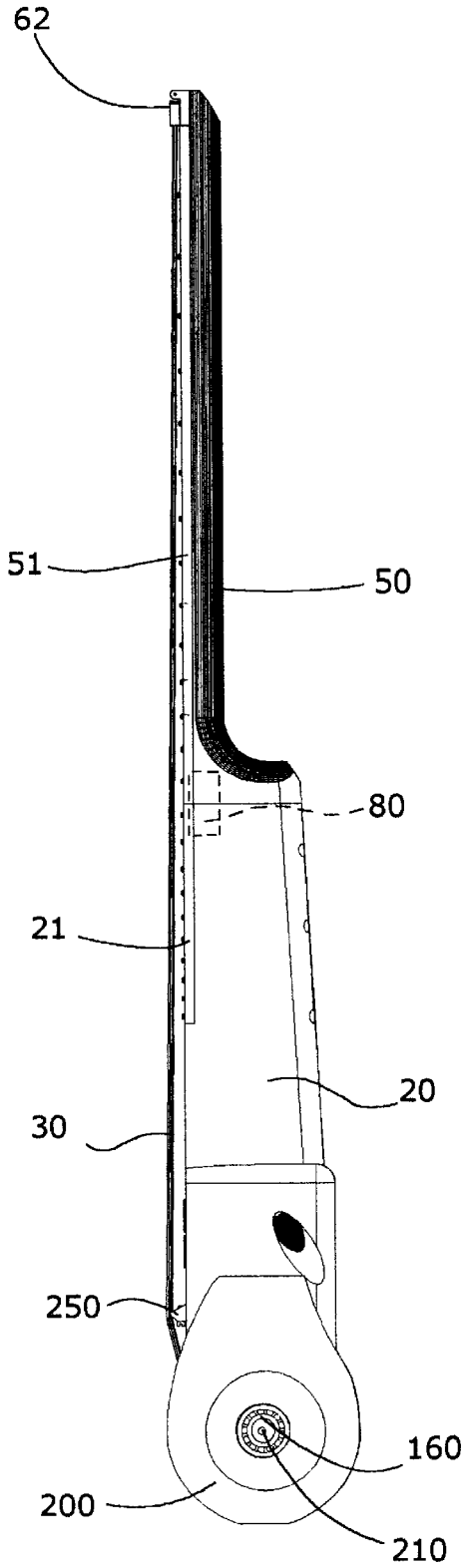
FIG. 2 is a side elevation view of a preferred embodiment of the invention with the neck its operative position.
Figure 10:
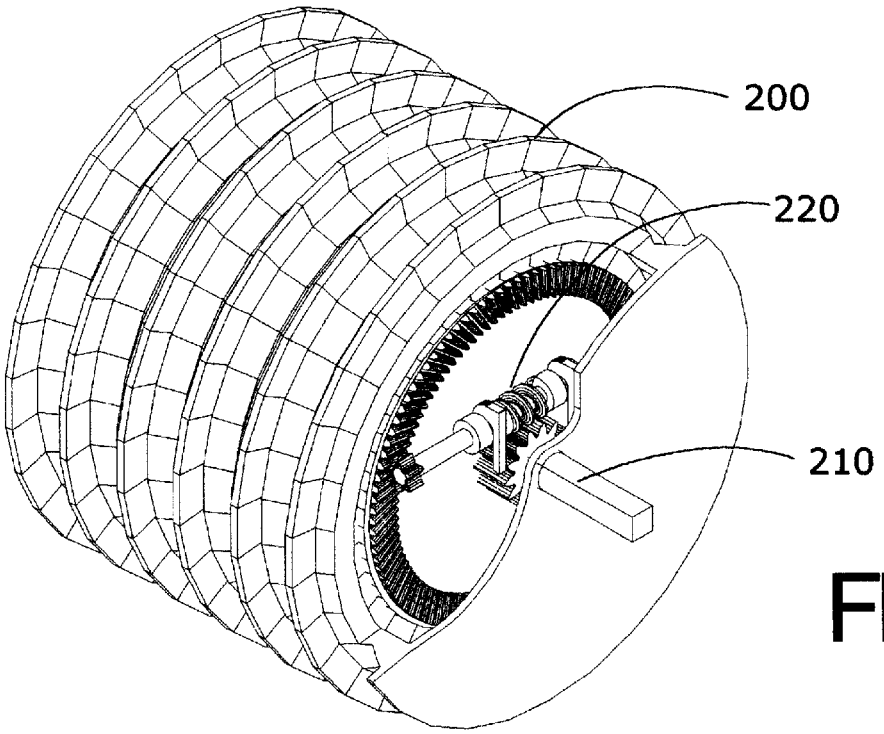
FIG. 10 is an enlarged perspective view in part section of a preferred embodiment of a tuning mechanism within the string mount.

Referring now to FIGS. 1 and 2 an embodiment of the present invention as it relates to the guitar is depicted. Shown is a body 20 with an upper surface 21, pivotally attached 80 to one end of the body 20 and in its operative position is a neck 50 with an upper surface 51. Rotatably secured on bearings 160 at the other end of the body 20 is a string mount in the form of a rolling drum 200 having a shaft 210, which may have slots suitable to attach strings and grooves to guide the winding of strings 30. Strings 30 are attached at their first ends 62 to the neck 50 and are stretched over the upper surface of the neck 51, the upper surface of the body 21, and contact with the bridge 250 a predetermined distance from the upper surface of the neck 51 and body 21 to be attached by their second ends to the rolling drum 200. As can be seen in FIG. 10, each string 30 may be tensioned by manipulating its corresponding tuning machine 220 located within the rolling drum 200. However, as those skilled in the art will appreciate, each string 30 could alternatively be tensioned by manipulating a corresponding tuning machine located at the opposing end of the neck 50

Figure 3:
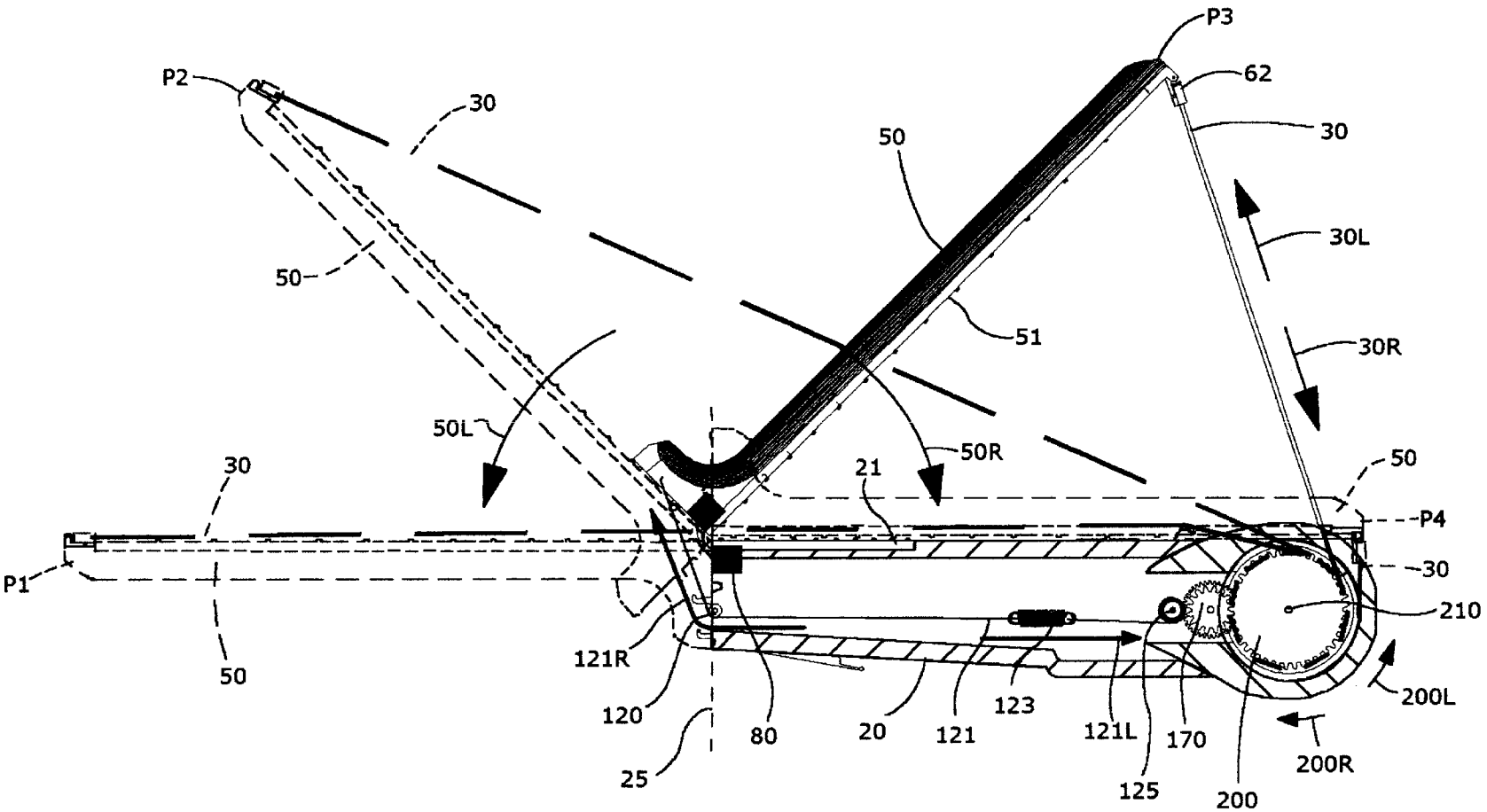
FIG. 3 is a side elevation in part section of a preferred embodiment of the invention shown with its neck in four positions from operative to folded.
Figure 7:
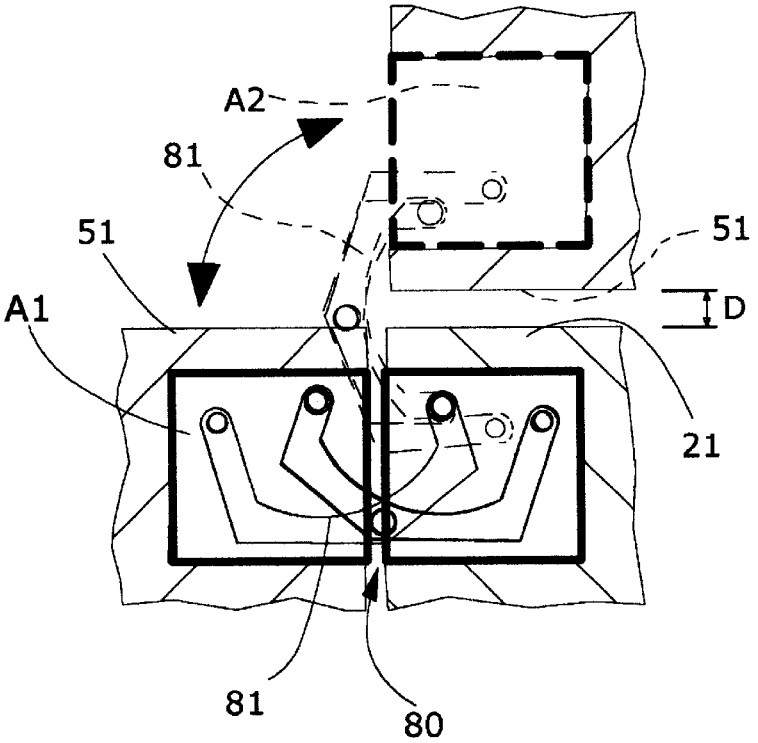
FIG. 7 is an enlarged side elevational view in part section of the concealed cylinder hinge that pivotally connects the neck and the body.

Referring now to FIG. 3, the concealed cylinder hinges 80 allow pivotal movement of the neck 50 from an operative position P1 to a folded position P4 with the upper surface of the neck 51 facing the upper surface of the body 21. FIG. 7 further shows that by its arrangement of linkages 81 the cylinder hinge 80 provides a distance D between the upper surface of the neck 51 and the upper surface of the body 21 when the neck is in its folded position whereby the hinge assumes position A2. When the neck is returned to its operative position, the hinge guides the neck to correct alignment with the body 20 whereby the hinge assumes position Al. Alternative embodiments of the present invention could use a single axis joint to provide pivotal movement of the neck 50. However this alternative arrangement would not provide the required gap for the neck 50 to fold on top of the body 20 and would most likely necessitate the disadvantageous removal of part of the upper surface of the body 21.

Figure 4:
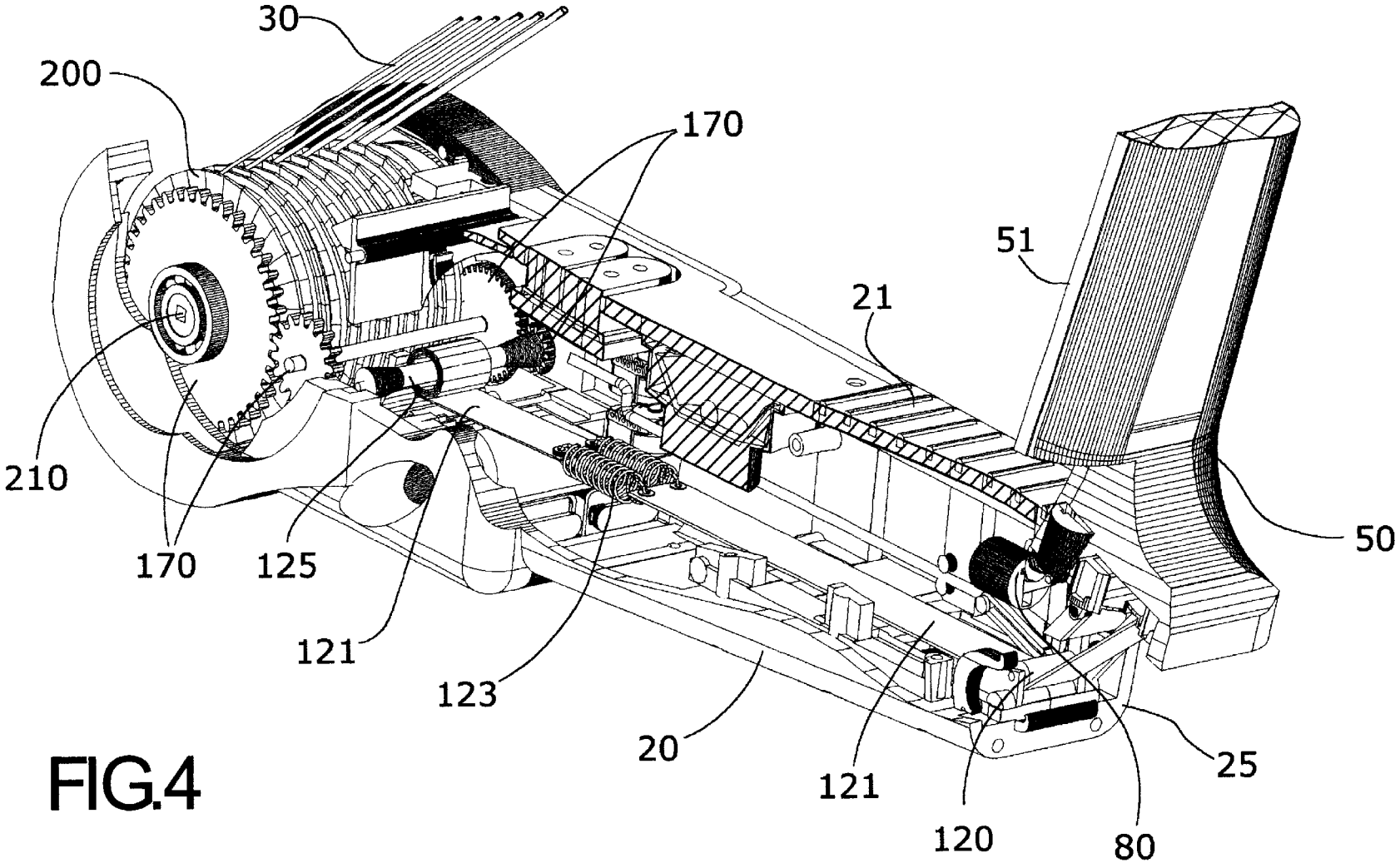
FIG. 4 is a perspective view in part section of a preferred embodiment of the invention with the neck in half way position between operative and folded.

FIG. 4 shows the drive means from neck 50 to rolling drum 200 embodied with a flexible linkage 121 provided with springs 123, a shaft 125 rotatably mounted in the body on a parallel axis to the shaft 210 of the rolling drum 200, and an arrangement of gears 170 mechanically interconnecting the shaft 125 and the rolling drum 200. An idler roller 120 is rotatably mounted in the body in an advantageous position for the flexible linkage to contact with. The flexible linkage 121 is connected at its first end to the neck 50 it then passes around the idler roller 120 where at its second end it is attached and wound around the shaft 125. Variances in the transmission ratio between the drive means and the rolling drum 200 may be achieved by selecting different ratios for the gears 170.

Referring now to FIG. 3 when the neck 50 is folded in direction 50R, the flexible linkage 121 is drawn by the neck 50 around the idler roller 120 in direction 121R and unwinds from the shaft 125, the shaft 125 in turn drives the gears 170 which in turn drive the rolling drum 200 in the direction 200R. The rolling drum 200 in turn winds the strings 30 onto itself in direction 30R.

When neck 50 is unfolded in direction 50L from P4 to its operative position P1 the strings 30 are unwound from the rolling drum 200 in direction 30L and thus rotate the rolling drum in direction 200L. The flexible linkage 121 is in turn drawn around the idler roller 120 in direction 121L.

As those skilled in the art will see from FIG. 3 no reduction in the tension of the strings 30 is necessary in order to fold the neck 50. During folding operations from P1 to P4 the strings are always under a state of tension as can be seen from the strings 30 in positions P2 and P3. Thus, the original tuning is preserved when the neck is returned from the folded position P4 to the operative position P1.

As indicated by FIG. 3, the strings 30, the attachment of the strings to the neck 62 and rolling drum 200, the neck 50, the rolling drum 200, the drive means from neck to rolling drum 121,123,125 and l7O, and the attachment of the drive means to the neck and to the rolling drum 200 define a closed system. Thus, when moving the neck 50 in direction 5OR or 50L the operator is not aware of the tension applied to the strings and is not required to provide significantly more exertion than that would be required to move the neck 50 if it was free of string 30 tension.

In order to accommodate varying rates of movement that occur between the strings 30 and the drive means from neck to rolling drum 121,125,170 when folding the neck 50 the flexible linkage is provided with an energy storing device such as a spring 123 as is described above and can be seen in FIG. 4. However, the energy-storing device could alternatively be provided at any convenient point in the said closed system with equal effect. For example, at the neck attachment points 62 for each string 30.

Figure 5:
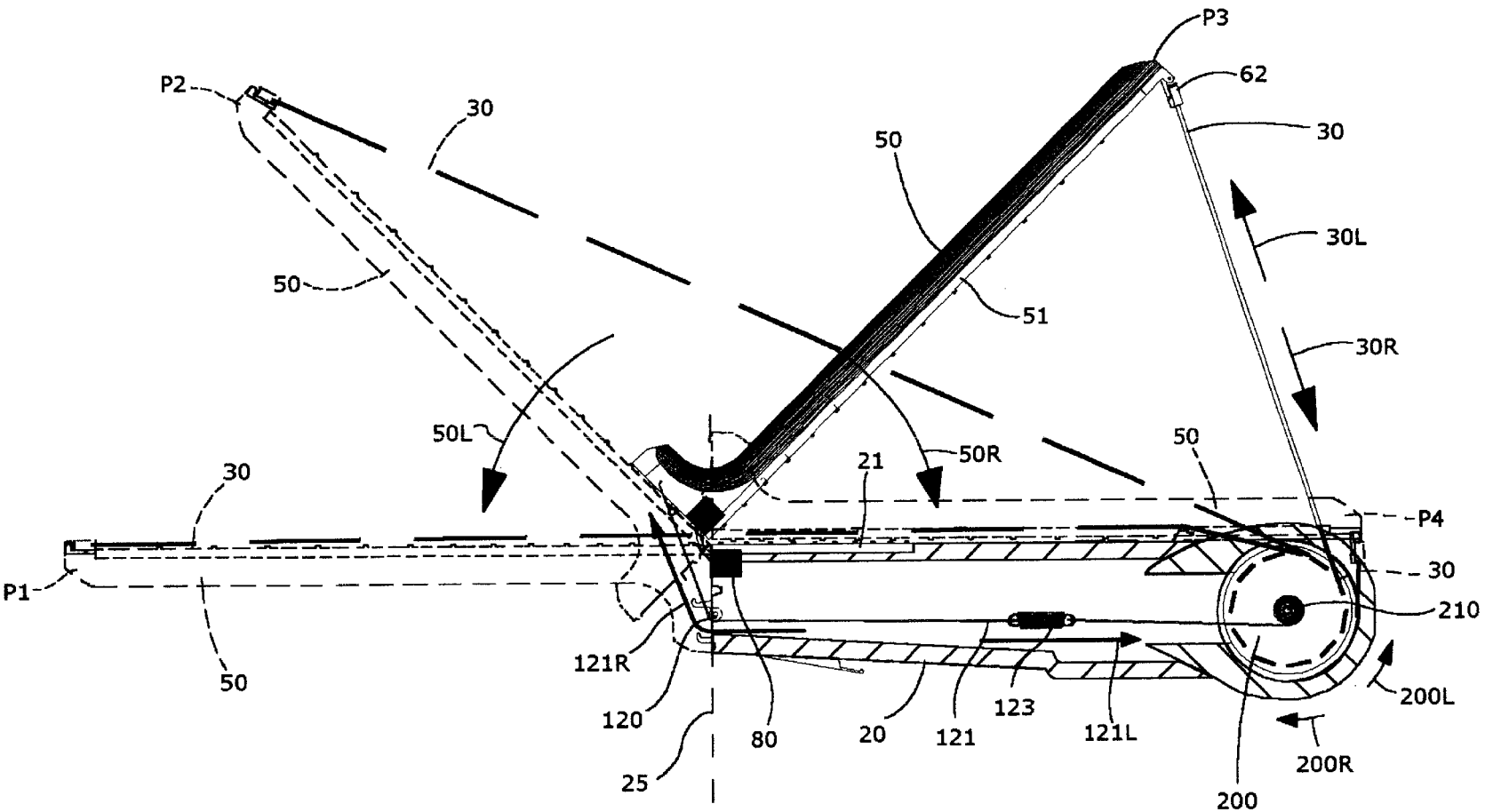
FIG. 5 is a side elevation view in part section of an alternative embodiment of the invention with its neck in four positions from operative to folded.

The embodiment in accordance to FIG. 5 is similar to the embodiment shown in FIG. 3 with the neck 50, body 20, strings 30, concealed cylinder type hinge 80, rolling drum 200 and drive means comprised of 121 and 123 also being provided. However in accordance with the embodiment of FIG. 5 the flexible linkage 121 is attached and wound around the shaft 210 of the rolling drum 200. In this embodiment, variances desired in the transmission ratio between drive means and rolling drum may be achieved by changing the diameter of the shaft 210.

Figure 6:
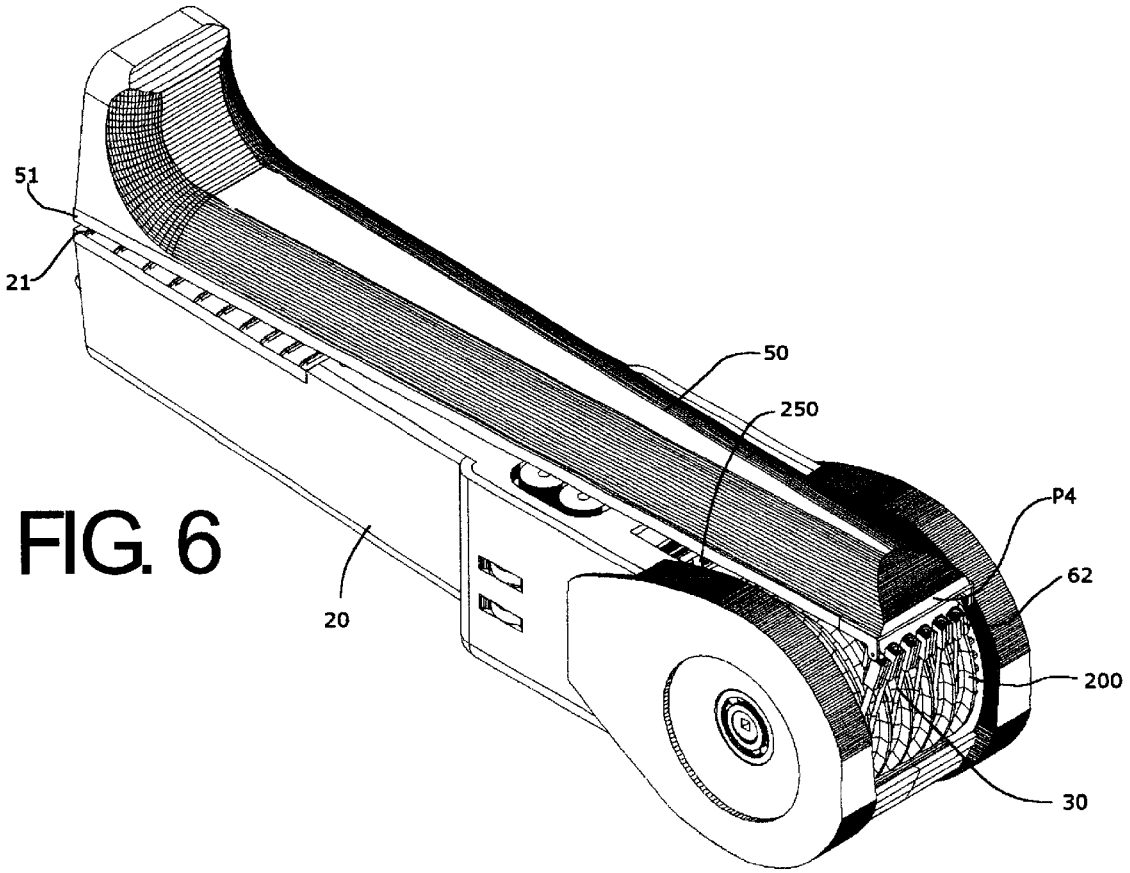
FIG. 6 is perspective view of a preferred embodiment of the invention with its neck in its folded position and its strings wound around the string mount.
Figure 8:
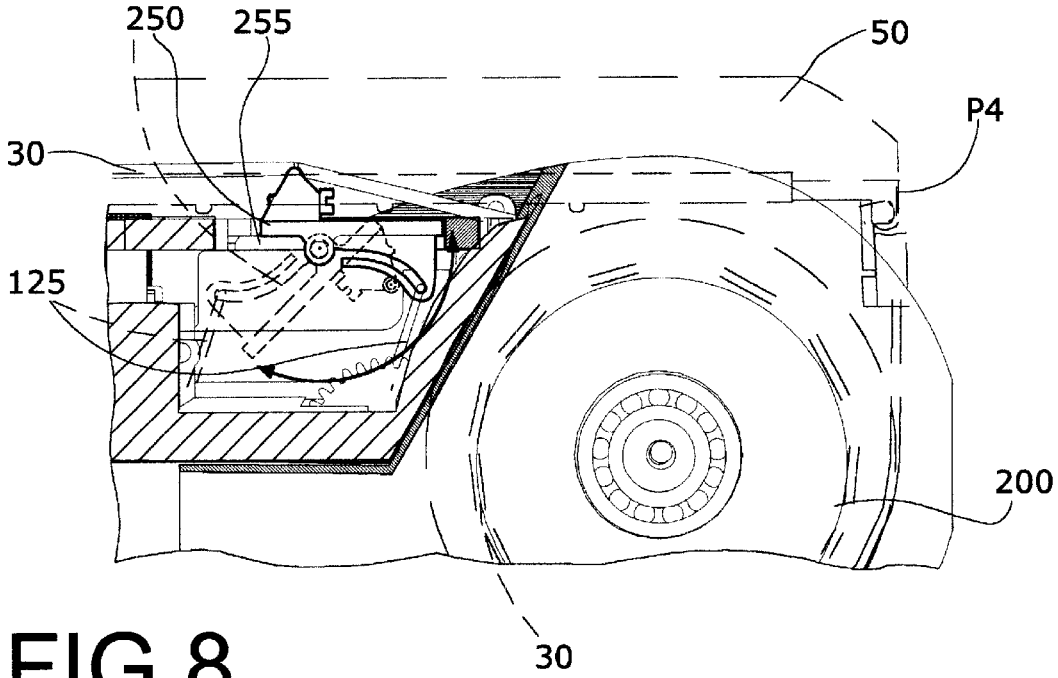
FIG. 8 is an enlarged side elevational view in part section of a preferred embodiment of the bridge rotated within the body when the neck is in a folded position.

FIG. 6 shows the present invention with the neck 50 in its folded position P4 the strings 30 are wound around the rolling drum in a circular form when in their stowed position. No excessive bending or buckling of the strings 30 takes place when the instrument is in a travel form. Referring to FIG. 8, in order to allow the neck 50 enough room to fold with its upper surface 51 facing flush to the upper surface of body 21 the bridge 250 in communication with the neck swings within the body 20 when the neck is brought to its folded position P4. Additionally, this arrangement completely protects the fragile bridge 250 from the rigors of transportation when the neck 50 is in a folded position P4. When the neck 50 is returned to its operative position P1, the bridge 250 swings back to rest upon the bridge bulkhead 255. This ensures that the bridge 250 provides the same quality of support to the strings 30 as a fixed bridge would.

In alternative embodiments, a fixed bridge could be used with the present invention or the need for a separate bridge could be circumvented by raising the string mount 200 so that it may also undertake the bridge function. But in both these embodiments, a gap corresponding to the height of the bridge as measured from the upper surface of the body 21 would result between neck 50 and body 20 when the neck 50 is in the folded position P4.

As can be seen in FIG. 6, In the preferred embodiment, the folding arrangement employed by the present invention protects the upper surface of the neck 51, the upper surface of the body 21, the bridge 250 and the strings 30; thus with these critical areas protected, the present invention may confidently transported without the need for a bulky case.

Figure 9:
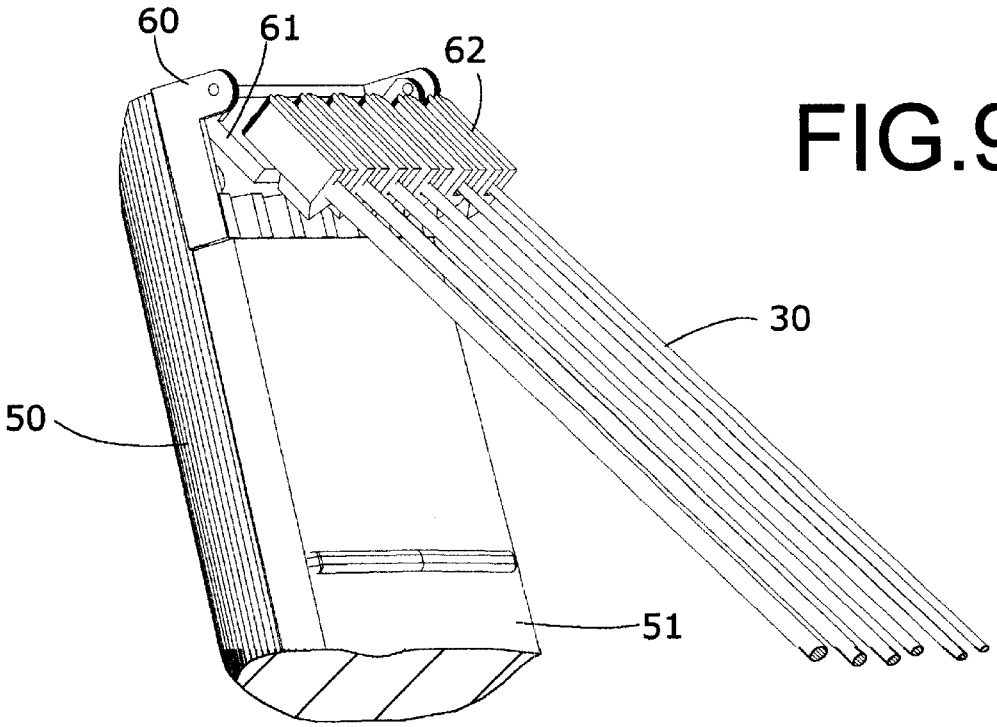
FIG. 9 is an enlarged perspective view of the means to provide varying incidences of strings to the neck.

FIG. 9 shows means to allow varying angles of incidence of the strings to the neck as an effect of the necks 50 pivotal movement around the body 20. String attachment points 62 are rotatably mounted on a plate 61 which in turn is free to rotate on a base 60 located at the end of the neck 50. It can be seen that as the neck 50 pivots towards the body 20 the different angles of incidence from each string 30 to the neck 50 are accommodated by each strings 30 continuously rotating attachment point 62 and the rotating plate 61. This feature of the present invention further protects the strings 30 from sharp bending when the neck 50 rotates to the folded position P4.

Figure 11:
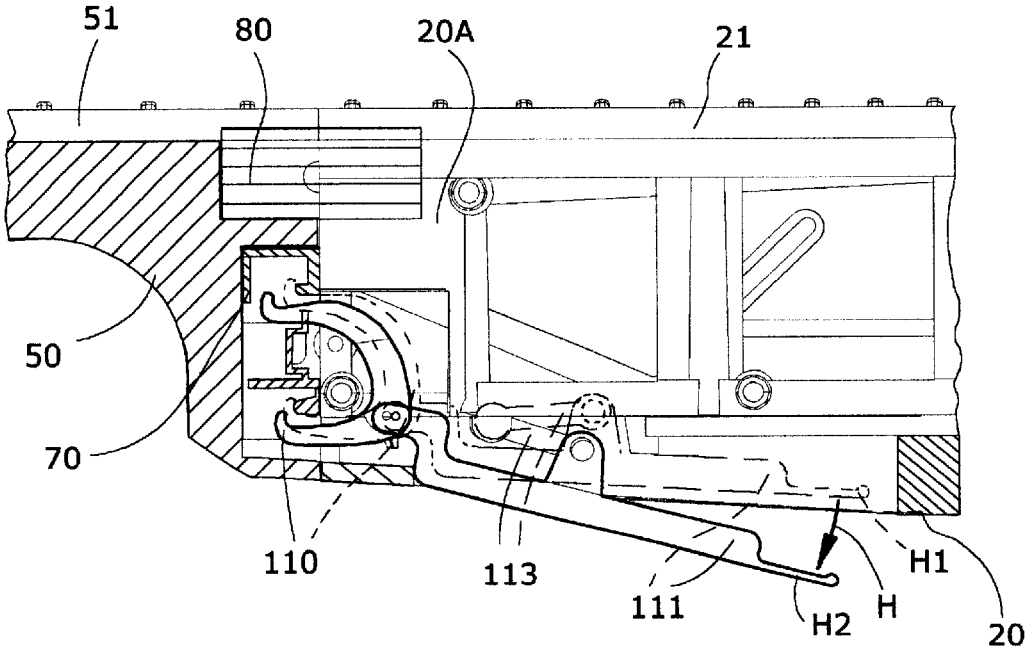
FIG. 11 is an enlarged side elevational view in part section of the means to releasably arrest the neck in an operative position.

As shown in FIGS. 3 and 4, The body 20 further defines a plane 25 that serves as an abutment limiting rotation of the neck 50 to its operative position P1 when the neck is moved away from the string mount 200. In order to prevent a folding of the neck 50 when in the operative position P1 a means to releasably arrest the neck 50 free of motion may be provided as shown in FIG. 11. In this embodiment, a clamp 110 with having lips inclined towards the body 20 extends from the body 20 into the neck 50, the neck 50 having surfaces formed 70 for the lips to fit into. Pivotally attached to the clamp 110 and extending away from the neck is a handle 111 , a toggle link 113 is pivotally connected at its first end to the body 20 and by its second end to the handle 111 whereby it is in communication with the clamp 110. The toggle link 113 is disposed at an oblique angle to the longitudinal axis of the handle 111 such that when the handle is moved towards the body 20 the toggle link 113 causes the clamp 110 to tightly arrest the neck 50 to the body 20 whereby the handle 111 assumes position HI.

In order to release the neck for folding, the operator simply pulls the handle 111 away from the body 20 in the direction of the arrow H as shown in FIG. 11 the handle 111 then causes the toggle link 113 to swing in the direction of the handle 111 which in turn releases the pressure administered by the clamp 110 to the neck 50. By pulling the handle 111 to its fullest extent H2 the clamp 110 is brought to a position whereby the neck 50 is unbounded and may be folded. This arrangement provides a convenient yet steadfast and rigid connection between neck 50 and body 20 comparable to that found on high quality non-transforming guitars and enhances the instrument's tone and sustain characteristics.

Figure 12:
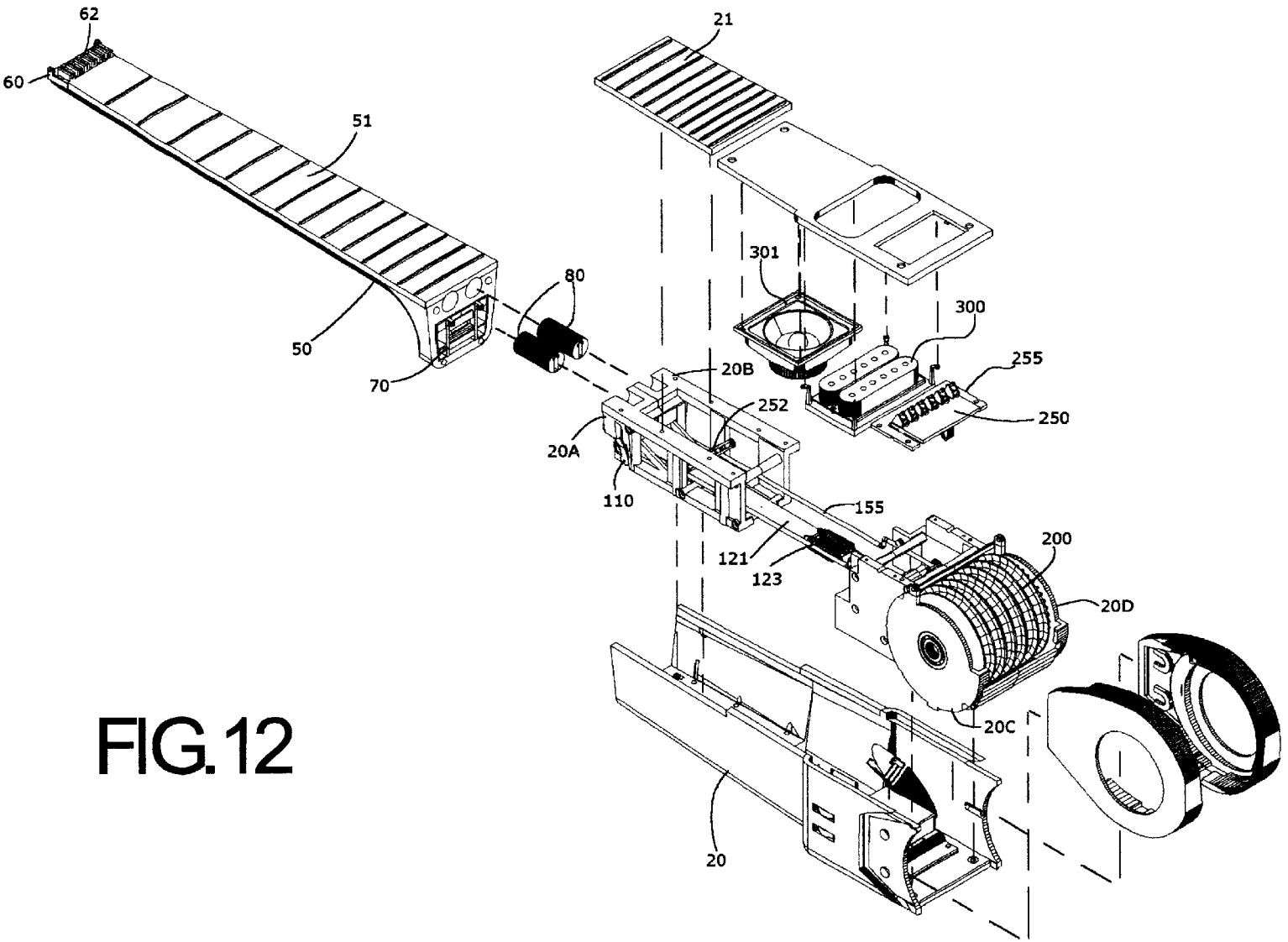
FIG. 12 is a perspective view of a preferred embodiment of the instrument exploded into its constituent parts.

FIG. 12 depicts a preferred embodiment of the invention exploded into its constituent parts. The body 20 is split into an outer shell 20, a front sub assembly 20A, 20B, and a rear sub assembly 20C, 20D. As shown, the preferred embodiment of the invention may be an electric guitar with pickups 300 and an on board speaker 301 for amplification.

Figure 13:
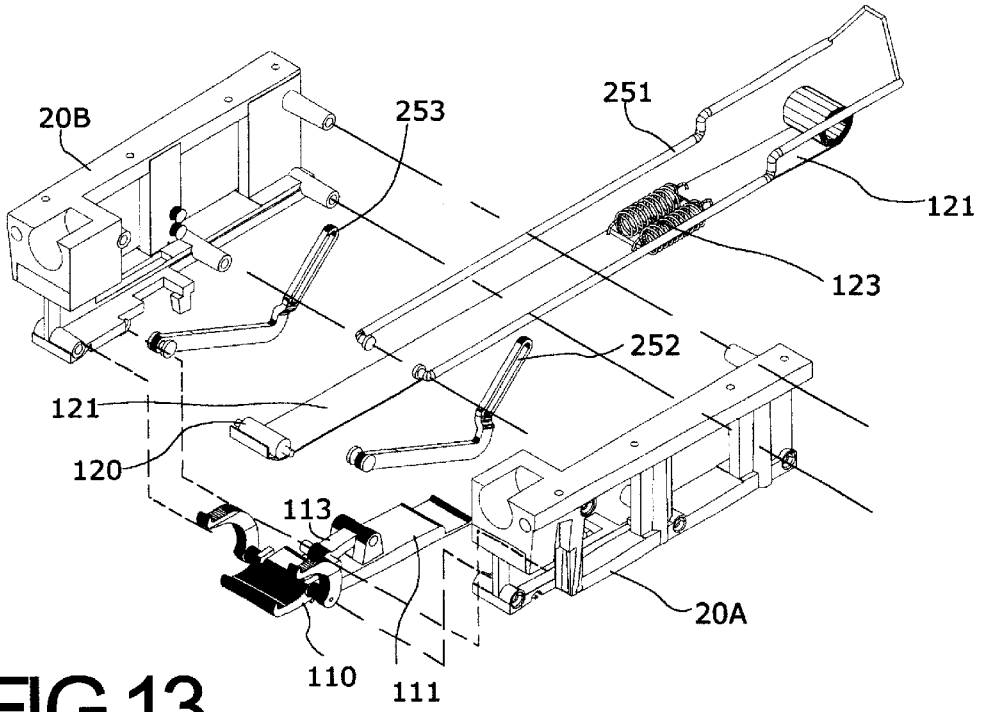
FIG. 13 is an exploded perspective view of a preferred embodiment for a housing of the neck arresting mechanism.
Figure 14:
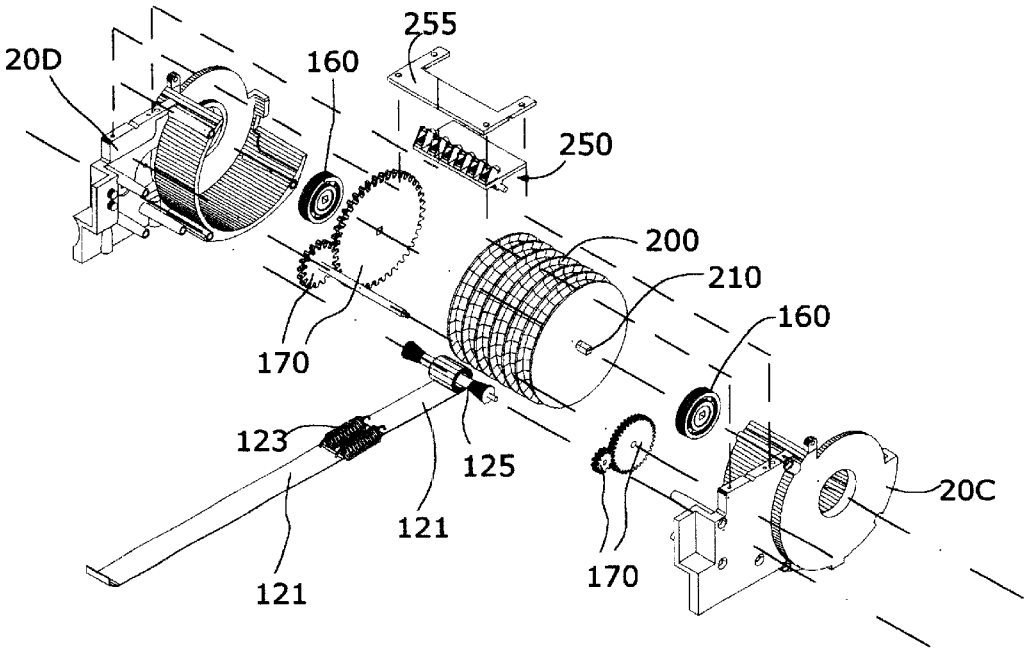
FIG. 14 is an exploded perspective view of a preferred embodiment for the housing of the string mount.

FIG. 13 shows the front assembly 20A and 20B further exploded to reveal the neck arresting means. FIG. 14 shows the rear assembly 20C, 20D further exploded showing the rolling drum 200 and shaft 125 and the gears 170 mechanically connecting the rolling drum 200 and shaft 125. It can be seen that the individual parts of the present invention can be easily cast from a combination of metals, plastics and composites.

Those ordinarily skilled in the art will appreciate that the present invention could be applied to many types of stringed instrument in many different forms. For example wooden instruments with hollow acoustic chambers such as an acoustic guitar or cello would benefit greatly from the present invention. Similarly, there are numerous ways to provide various parts of the invention. For example, the drive means from neck to rolling drum could comprise rods and gears in various arrangements but in most cases these would adversely effect tone, add weight and increase the complexity of the instrument. Similarly, there are many alternative ways to provide pivotal attachment of the neck to the body. For example, an alternative embodiment could use a double link hinge design to provide distance between neck and body when the neck is folded, however this type of arrangement would not provide the same accuracy in neck body alignment as afforded by the concealed cylinder hinge provided in the preferred embodiment.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A stringed instrument with folding neck comprising:

an instrument body having an upper portion and lower portion;

a neck pivotally attached generally to the upper portion of said body so as to allow rotation of said neck from an operative position to a folded position;

a string mount rotatably secured generally to said lower portion of the body;

at least one string having a first and a second end, said first end attached to said neck the second end attached to said string mount; and drive means for rotating the string mount in direct response to pivotal movement of said neck towards said body so as to wind said at least one string onto said string mount when said neck is pivotally moved between said operative position and said folded position.

2. The stringed instrument as claimed in claim 1 wherein said pivotal attachment of said neck to said body comprises at least one concealed cylinder hinge.

3. The stringed instrument as claimed in claim 1 wherein said neck and said body each have an upper surface and said neck in said folded position rests on top of body with the upper surface of the neck facing the upper surface of the body.

4. The stringed instrument as claimed in claim 1 wherein said string mount comprises a shaft coaxially mounted thereon; said shaft suitable for the wrapping of flexible linkage.

5. The stringed instrument as claimed in claim 1 wherein said string mount comprises a rolling drum.

6. The stringed instrument as claimed in claim 1 wherein said string mount comprises grooves to guide the winding of said at least one string.

7. The stringed instrument as claimed in claim 1 wherein rotation of said string mount preserves tension in the said at least one string when said neck is pivotally moved from said operative to said folded position whereby said at least one string in a stowed position is substantially wound thereon.

8. The string instrument as claimed in claim 1 wherein said at least one string, said attachment of at least one string to said neck and said string mount, said drive means, said attachment of said drive means to said neck and said string mount, said neck and said string mount define a closed system.

9. The stringed instrument as claimed in claim 8 wherein said closed system further comprises an energy-storing device.

10. The stringed instrument as claimed in claim 1 wherein said drive means for rotating said string mount comprises a flexible linkage having a first end and a second end; a shaft rotatably mounted within body; gear means for mechanically interconnecting said shaft and the string mount; said flexible linkage attached at one end to said neck and by its second end attached and wrapped around said shaft.

11. The string instrument as claimed in claim 10 wherein said flexible linkage comprises an energy-storing device.

12. The stringed instrument as claimed in claim 10 further comprising an idler roller mounted rotatably in body between said neck and said string mount for said flexible linkage to contact with.

13. The stringed instrument as claimed in claim 4 wherein said drive means for rotating said string mount comprises a flexible linkage having a first end and a second end; said first end attached to said neck said second end attached and wrapped around said shaft of string mount.

14. The string instrument as claimed in claim 13 wherein said flexible linkage in said drive means comprises an energy-storing device.

15. The string instrument as claimed in claim 13 where said drive means from said neck to said string mount further comprises at least one gear.

16. The stringed instrument as claimed in claim 13 further comprising an idler roller mounted rotatably in body between said neck and said string mount for said flexible linkage to contact with.

17. The stringed instrument as claimed in claim 1 further comprising means to adjust tension of said at least one string.

18. The stringed instrument as claimed in claim 17 wherein said means to adjust tension of said at least one string comprises a corresponding tuning machine located within said string mount.

19. The stringed instrument as claimed in claim 1 further comprising a bridge with a critical contact surface contiguous with said at least one string.

20. The stringed instrument as claimed in claim 19 wherein said bridge is rotatably mounted to said body in communication with said neck so as to be rotated within said body when said neck is in said folded position.

21. The stringed instrument as claimed in claim 3 wherein said body further defines a plane generally normal to the said upper surface of said body serving as an abutment to said neck whereby pivotal movement of said neck away from string mount is limited to said operative position; said stringed instrument further comprising means to releasably arrest said neck free of motion when said neck is in said operative position.

22. The string instrument as claimed in claim 21 wherein said means to releasably arrest said neck free of motion comprises a cavity in said neck; a cavity in said body aligned with said neck cavity when said neck is in said operative position; a clamp with first end and second end moveably mounted within said body cavity; said first end of clamp extending into neck cavity and having at least one lip inclined towards body; said neck cavity having surfaces formed for at least one lip to fit into; a handle suitable for manipulation by human fingers pivotably attached to second end of clamp; and a toggle link pivotably attached at its first end to body and by its second end to said handle.

23. The stringed instrument as claimed in claim 1 wherein said attachment of said at least one string to said neck comprises means to allow varying angles of incidence of said at least one string to said neck as an effect of said necks pivotal movement towards said body.

* * * * *